US005762263A

United States Patent [19]

Chamberlain, IV

[11] Patent Number: 5,762,263

[45] Date of Patent: Jun. 9, 1998

[54] PRODUCT CONTAINER CONTAINING A MAGNETIC IDENTIFIER

[75] Inventor: Frederick Rockwell Chamberlain, IV, Vista, Calif.

[73] Assignee: Eastman Kodak Company, Rochester, N.Y.

[21] Appl. No.: 685,738

[22] Filed: Jul. 24, 1996

Related U.S. Application Data

[63] Continuation-in-part of Ser. No. 448,912, May 24, 1995, abandoned.

[51] Int. Cl.[6] ..... B65D 5/42

[52] U.S. Cl. ..... 229/132; 283/83; 324/228; 428/356; 428/694 B; 428/900

[58] Field of Search ..... 229/132, 136, 229/3.1, 102, 203; 428/34.2, 34.3, 34.8, 35.2, 35.7, 356, 694 B, 694 BA, 694 OH, 900; 360/131, 132; 324/228; 206/818, 822; 283/81, 83

[56] References Cited

U.S. PATENT DOCUMENTS

| | | | |
|---|---|---|---|
| 3,140,809 | 7/1964 | Hickin et al. | 209/132 |
| 3,878,367 | 4/1975 | Fayling et al. | 360/131 |
| 4,067,009 | 1/1978 | Constant | 342/25 |
| 4,427,481 | 1/1984 | Smith et al. | 156/306.6 |
| 4,693,775 | 9/1987 | Harrison et al. | 428/900 |
| 4,781,773 | 11/1988 | Instance | 206/822 |
| 4,836,378 | 6/1989 | Lephardt | 229/203 |
| 4,937,995 | 7/1990 | Deffeyes et al. | 52/515 |
| 4,992,636 | 2/1991 | Namicki et al. | 219/735 |
| 5,036,310 | 7/1991 | Russell | 340/569 |
| 5,206,065 | 4/1993 | Rippingale | 428/98 |
| 5,407,891 | 4/1995 | Matsushita | 503/204 |

FOREIGN PATENT DOCUMENTS 1087815 10/1967 United Kingdom .

*Primary Examiner*—Gary E. Elkins
*Attorney, Agent, or Firm*—William F. Noval

[57] ABSTRACT

A non-magnetic material such as cardboard or plastic is used as the packaging material for the product to be protected from counterfeiting. The packaging material is configured as a box whose parts are bonded together by use of a hot-melt adhesive. The adhesive contains magnetic particles such as barium ferrite, and small molten globules of adhesive are applied to appropriate surfaces of the box during box fabrication. The box parts are folded to form the finished box, and under the application of pressure the globules of adhesive spread out and solidify, bonding the box surfaces together. It will be noted that presence of the magnetic particles in the adhesive does not modify the box fabrication procedure in any way, and that the box material may be processed and the box's surfaces printed in the usual manner.

8 Claims, 2 Drawing Sheets

PRODUCT CONTAINER CONTAINING A MAGNETIC IDENTIFIER

CROSS REFERENCE TO RELATED APPLICATIONS

This is a continuation-in-part of application Ser. No. 08/448,912, filed 24 May 1995, entitled PRODUCT CONTAINER CONTAINING A MAGNETIC IDENTIFIER by Frederick R. Chamberlain, IV, now abandoned.

FIELD OF THE INVENTION

This invention relates to a product container, and in particular to a container incorporating a non-obvious marker as a identifier and authenticator of a genuine product.

DESCRIPTION RELATIVE TO THE PRIOR ART

The growing global economy has been accompanied by an alarming increase in pirating and counterfeiting of well known products. In addition to counterfeiting of the products themselves, the packaging which contains and identifies the product is being duplicated by means of sophisticated printing systems, and the duplicating of the container is done with such fidelity that it is difficult to distinguish it from the genuine article. This undetected pirating results in losses of billions of dollars in revenue to legitimate businesses, and also dilutes and compromises the valuable trademarks of the products being pirated.

Before describing the invention which uses an adhesive mixed with magnetic particles, it will be noted that in the prior art disclosure has been made of magnetic particles incorporated in an adhesive. For example, U.S. Pat. No. 4,937,995 discloses use of magnetic material added to an adhesive used as a roof sealant where the measurement of the inductance of the adhesive in a roof seam allows the identification of the supplier of the roofing material. In U.S. Pat. No. 4,427,481 magnetized magnetic particles in a flowable adhesive, "pull" two members forming a joint together by magnetic attraction to aid sealing by the adhesive. Other uses of magnetic particles in an adhesive are disclosed in the prior art, but unlike the teaching of the present invention such disclosures are not directed to detection of counterfeit products.

SUMMARY OF THE INVENTION

A non-magnetic material such as cardboard or plastic is used as the packaging material for the product to be protected from counterfeiting. The packaging material is configured as a box whose parts are bonded together by use of a hot-melt adhesive. The adhesive contains magnetic particles such as barium ferrite, and small globules of molten adhesive are applied to appropriate surfaces of the box during box fabrication. The box parts are folded to form the finished box, and under the application of pressure the globules of adhesive spread out, cool and solidify, bonding the box surfaces together. It will be noted that presence of the magnetic particles in the adhesive does not modify the box fabrication procedure in any way, and that the box material may be processed and the box's surfaces printed in the usual manner.

The solidified adhesive serves as a magnetic recording medium by virtue of the imbedded magnetic particles. A magnetic mark may be recorded either by means of a record head, or by means of a magnetic roller. The magnetic recording of this mark, the presence of which is not visually discernible, is detectable by means of a magnetic reproduce head or a magnetic optical viewer responsive to magnetized media, and the encoded recorded information used to authenticate the genuineness of the packaged product.

BRIEF DESCRIPTION OF THE DRAWINGS

The invention will be described with respect to the drawings of which.

DESCRIPTION OF THE PREFERRED EMBODIMENTS

Figure 1:
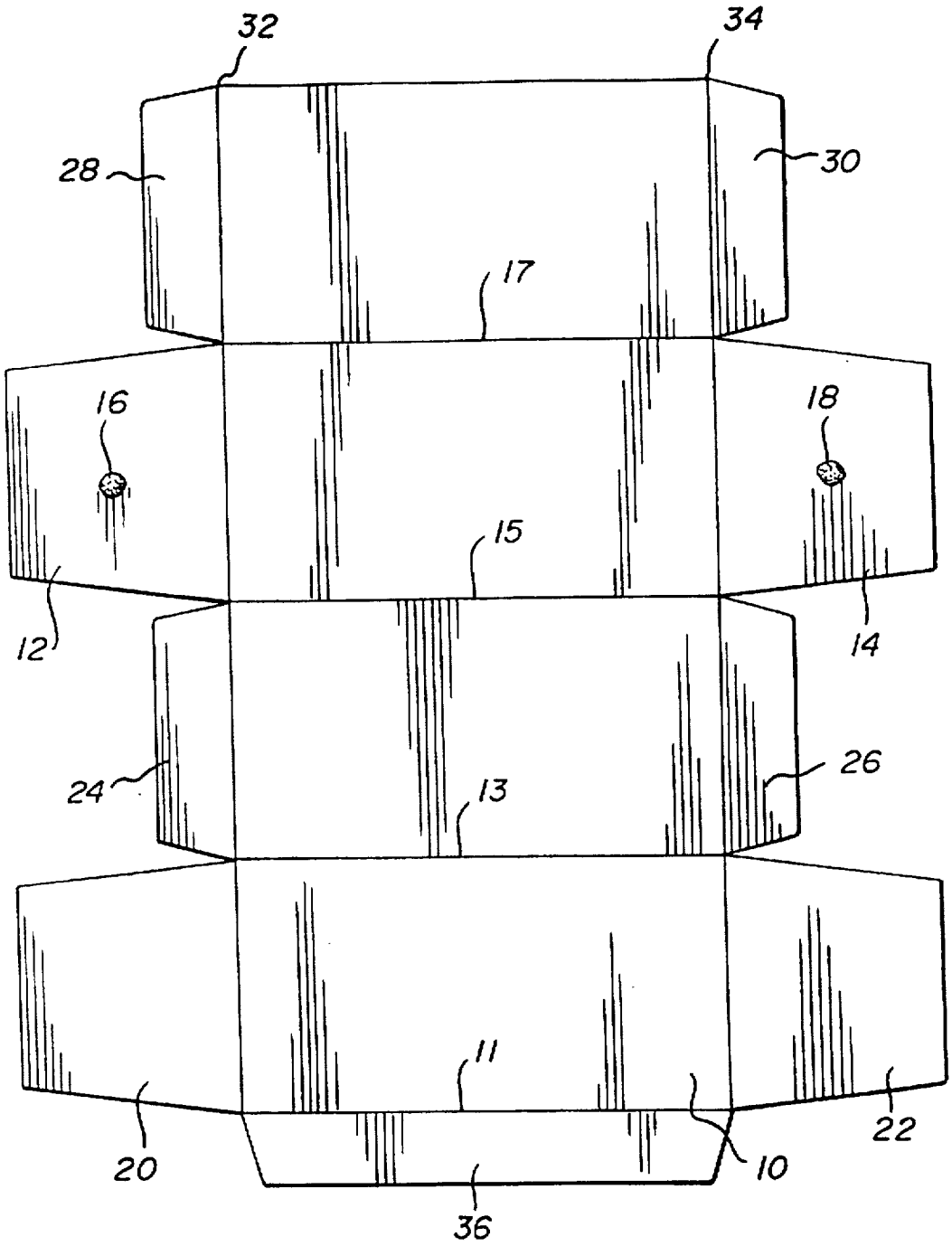
FIG. 1 illustrates an unassembled box with small globules of adhesive containing magnetic particles applied to appropriate box tabs.
Figure 2:
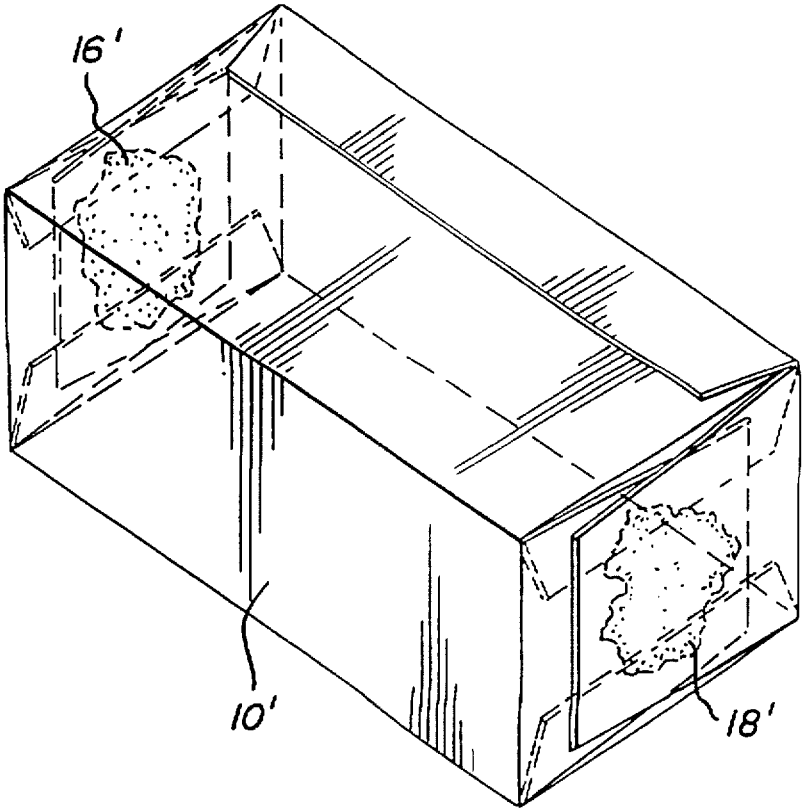
FIG. 2 is a drawing of the box of FIG. 1, assembled and held together by an adhesive having magnetically recordable areas.

A packaging material typically made of cardboard, is shaped as a pattern 10 as shown in FIG. 1. To form a box 10', (FIG. 2), the pattern 10 surfaces are folded along the lines 13, 15, 17, and the tabs 16,18,20,22,24,26,28,30 are folded inward along the lines 32,34, resulting in a rectangular parallelepiped box 10'. (In the drawings, different but related elements are identified by the same reference character, albeit that the different elements are distinguished by primes.) Prior to the folding operation, small globules of adhesive containing magnetic particles 16,18 are placed on the tabs 12,14. A suitable adhesive is thermoplastic wax and suitable magnetic particles are barium ferrite, and to form the adhesive the thermoplastic wax and the barium ferrite particles are combined by weight in the ratio of 1:1. In fabrication of the box 10', the globules of molten adhesive 16,18 flow under applied pressure, cool, solidify, and the tabs 12, 14 remain firmly attached to the tabs 20, 22 respectively when the pressure is removed. In addition to affixing tab 14 to tab 22, and tab 12 to tab 20, under the applied pressure the globules of adhesive 16,18 spread into flattened disks, 16'18' of magnetic media suitable for supporting magnetic recording thereon. The box 10' is now complete with the product inside it; the box having been folded around the product. The box 10' is now sealed by folding and gluing the tab 36.

Anti-counterfeiting information may be encoded and recorded on the disks 16', 18' by a magnetic recording head or by means of a magnetic recording roller. To authenticate the genuineness of the product packaged in the sealed box 10', a magnetic reproduce head or a magnetic optical viewer is used to scan the recorded disks 16', 18' recovering the previously recorded information.

The invention may be carried out using any form of solidifying adhesive. The adhesive. The adhesive may be thermoplastic or thermosetting material. Adhesives such as epoxy resins, silicones, cements, glues, waxes, or hot melt glue can be used.

The invention may be carried out with any particulate magnetic material having a coercivity of more than 50 Oersteds. Materials with coercivities less than this would be subject to accidental erasure due to stray fields. Particulate magnetic materials prepared for use in magnetic media manufacture are suitable for use in the invention. Materials such as barium or strontium ferrite, iron oxide, chromium dioxide, and cobalt doped iron oxide may be used. The particle size should be less than the thickness of the desired final adhesive bond thickness, to enable that bond thickness to be realized. For almost all of the potential applications and available magnetic particles this requirement is easily satisfied.

The preferred adhesive for produce packaging applications is a thermoplastic hot melt glue. This material may be melted, blended with magnetic particles, and then solidified into the form of chips, pellets, rods or blocks and stored for long periods of time without any particle agglomeration or settling. The magnetic adhesive may then be used by heating it to remelt it, applying it to the product packaging, closing the package, and allowing the adhesive to cool and resolidify, sealing the package.

The preferred magnetic particle for use in the invention is barium ferrite, strontium ferrite, or blends of these two materials. The material has a coercivity of over 3000 Oe, and is therefore very difficult to erase. It is very easy to disperse into the preferred hot melt adhesive by simple mixing processes.

The invention is further illustrated in the following non-limiting examples, each of which uses equal parts by weight of adhesive and magnetic particles. The particle concentration may be much lower in each example depending on the specifics of the application, such as packaging thickness and desired surface field strength.

EXAMPLE 1

Hot glue adhesive was heated to 200° C. in an open stainless steel container. An equal weight of SecureMag H barium ferrite magnetic particles available from Hoosier Magnetics was added to the molten glue and dispersed by stirring vigorously with a glass rod. A small dab of the liquid mixture was placed on the inside tab of a cardboard film box, pressed into place against the opposite tab, and allowed to cool, sealing the box. The assembly was then magnetically recorded using a roller recorder. The recording could then be easily observed using a B-1022 magnetic viewer available from the Arnold Engineering Co.

EXAMPLE 2

A magnetic identifier was prepared with equal parts by weight of RTV silicone rubber sealant and B-353 magnetic iron oxide particles from Magnox Corporation at room temperature. The two components were placed on a sheet of paper and mixed thoroughly with a wooden stir stick. A small dab of the liquid mixture was placed on the inside tab of a cardboard film box, pressed into place against the opposite tab, and allowed to solidify, sealing the box. The assembly was then magnetically recorded using a roller recorder. The recording could then be easily observed using a B-1022 magnetic viewer available from the Arnold Engineering Co.

EXAMPLE 3

A magnetic identifier was prepared and observed as in Example 2, with the modification that the adhesive used was Rubber Cement and the magnetic particles were Samarium Cobalt from Hitachi.

EXAMPLE 4

A magnetic identifier was prepared and observed as in Example 2, with the modification that the adhesive used was a two-part 5 minute epoxy (biphenyl epoxy resin and polymercaptan hardener) and the magnetic particles were chromium dioxide from Dupont.

The invention has been described in detail with particular reference to preferred embodiments thereof, but it will be understood that variations and modifications can be effected within the spirit and scope of the invention.

What is claimed is:

1. A container comprising:

non magnetic packaging material forming said container:

adhesive material applied to said non magnetic material forming said container for structurally fixing said container in an assembled configuration;

magnetic material dispersed in said adhesive means, and encoded information magnetically recorded on said magnetic recordable means.

2. The container of claim 1 wherein said adhesive material is a hot melt thermoplastic wax.

3. The container of claim 2 wherein said magnetic material are barium ferrite particles.

4. The container of claim 1 wherein said packaging material is a paper based material.

5. A container comprising:

a non magnetic packaging material having tabs, wherein a container may be assembled from said packaging material;

an adhesive applied to said tabs to stably set said container.

magnetically recordable particles dispersed in said adhesive, and magnetically recorded information recorded on said magnetically recordable particles.

6. The container of claim 5 wherein said adhesive comprises a hot melt thermoplastic wax.

7. The container of claim 5 wherein said magnetically recordable particles are barium ferrite particles.

8. The container of claim 5 wherein said packaging material is a paper based material.

* * * * *